US011807953B2

(12) United States Patent
Zhang et al.

(10) Patent No.: US 11,807,953 B2
(45) Date of Patent: Nov. 7, 2023

(54) ELECTROPLATING DEVICE AND ELECTROPLATING SYSTEM

(71) Applicants: Tyco Electronics (Shanghai) Co., Ltd., Shanghai (CN); Tyco Electronics (Suzhou) Ltd., Suzhou (CN)

(72) Inventors: Daiqiong (Diana) Zhang, Shanghai (CN); Chunyan (Cherie) Zhou, Shanghai (CN); Dongqing (Gates) Peng, Suzhou (CN); Yuelin (Kevin) Liang, Shanghai (CN); Zhongxi Huang, Shanghai (CN)

(73) Assignees: Tyco Electronics (Shanghai) Co., Ltd., Shanghai (CN); Tyco Electronics (Suzhou) Ltd., Suzhou (CN)

( * ) Notice: Subject to any disclaimer, the term of this patent is extended or adjusted under 35 U.S.C. 154(b) by 46 days.

(21) Appl. No.: 17/588,243

(22) Filed: Jan. 29, 2022

(65) Prior Publication Data

US 2022/0243350 A1 Aug. 4, 2022

(30) Foreign Application Priority Data

Jan. 29, 2021 (CN) ..... 202110132818.9

(51) Int. Cl.
*C25D 3/56* (2006.01)
*C25D 5/18* (2006.01)
*C25D 17/10* (2006.01)

(52) U.S. Cl.
CPC ..... *C25D 3/56* (2013.01); *C25D 5/18* (2013.01); *C25D 17/10* (2013.01)

(58) Field of Classification Search
CPC ..... C25D 7/0621; C25D 7/0628
See application file for complete search history.

(56) References Cited

U.S. PATENT DOCUMENTS 2,511,395 A 6/1950 Walter et al.
2008/0179192 A1* 7/2008 Arvin ..... C25D 17/12 204/242

FOREIGN PATENT DOCUMENTS

CN 104862767 A 8/2015
JP 2006257492 A 9/2006
WO 2012011727 A 1/2012

OTHER PUBLICATIONS

Chinese First Office Action dated May 31, 2023, with English translation thereof, corresponding to Application No. 202110132818.9, 19 pages.

* cited by examiner

*Primary Examiner* — Hosung Chung
(74) *Attorney, Agent, or Firm* — Barley Snyder

(57) ABSTRACT

An electroplating device for electroplating an alloy comprising a plurality of metals on a workpiece includes an electroplating bath, a plurality of groups of anodes, and a power supply device. The electroplating bath contains an electroplating solution in which the workpiece as a cathode is at least partially immersed. Each of the plurality of groups of anodes provides at least one metal required for electroplating. An electrolytic potential of at least one metal of each group of anodes is distinct from that of at least one metal of any other group of anodes. The power supply device adjusts the proportion of current transmitted to each group of anodes according to the proportion of the metals in the alloy.

20 Claims, 8 Drawing Sheets

ELECTROPLATING DEVICE AND ELECTROPLATING SYSTEM

CROSS-REFERENCE TO RELATED APPLICATIONS

This application claims the benefit of Chinese Patent Application No. 202110132818.9 filed on Jan. 29, 2021 in the China National Intellectual Property Administration, the whole disclosure of which is incorporated herein by reference.

FIELD OF THE INVENTION

The present disclosure relates to an electroplating device and an electroplating system including the electroplating device.

BACKGROUND

In traditional electroplating processes, a cathode material is connected to a negative pole of a power rectifier, an anode material is connected to a positive pole of the power rectifier, and the cathode material and anode material are immersed in an electroplating solution containing ions to be electroplated. The cathode material has a reduction reaction, and the ions to be electroplated are reduced to atoms on the cathode material, so as to cover the surface of the cathode material; the anode material has an oxidation reaction. The anode material generally adopts the metal plating material, which is oxidized into the ions to be electroplated and dissolved into the electroplating solution. This maintains the stability of the concentration of the ions to be electroplated in the electroplating solution and obtain higher electroplating efficiency. For example, single metal electroplating includes gold plating, rhodium plating, silver plating, palladium plating, nickel plating, copper plating, tin plating, indium plating, bismuth plating, lead plating, cobalt plating, iron plating, zinc plating, etc., and its process is relatively stable and controllable. However, in order to obtain better mechanical, electrical and anti-corrosion properties, increasing binary or multicomponent alloy electroplating have also been developed and applied.

The concentration ratio of multiple ions in the electroplating solution of multicomponent alloy electroplating is not easy to maintain, which affects the alloy ratio in the coating. In addition, the uneven distribution of current density and the electrode efficiency of cathode and anode also affect the alloy proportion in the coating to a greater extent. At present, there are three kinds of anodes for alloy electroplating: insoluble anodes, anodes made of a single soluble metal, or anodes made of soluble alloy corresponding to the coating. For the three kinds of anodes, it is difficult to control the alloy proportion. Either the anode is easy to passivate but not easy to dissolve, resulting in low electroplating efficiency, or the ion replacement between anode metal and electroplating solution causes instability of electroplating solution, waste of metal precipitation, decline of coating quality, etc.

For example, in the solution of an anode made of a single soluble metal, the fusible metal is generally the metal with the highest content in alloy electroplating. Its standard electrode potential must be higher than that of other metals in the alloy, or there is a stable metal complexing agent in the electroplating solution to reduce the standard electrode potential of other metal ions. Otherwise, in the case of no electricity, the metal ions with high potential of the standard electrode will be replaced on the low potential metal anode. This solution is generally applicable to thick standard metal electroplating. In the electroplating process, the coating ratio is often out of balance. Specifically, the concentration of single metal anode dissolved in the electroplating solution easily increases.

SUMMARY

According to an embodiment of the present disclosure, an electroplating device for electroplating an alloy comprising a plurality of metals on a workpiece comprises an electroplating bath, a plurality of groups of anodes, and a power supply device. The electroplating bath contains an electroplating solution in which the workpiece as a cathode is at least partially immersed. Each of the plurality of groups of anodes provides at least one metal required for electroplating. An electrolytic potential of at least one metal of each group of anodes is different from that of at least one metal of any other group of anodes. The power supply device is adapted to adjust the proportion of current transmitted to each group of anodes according to the proportion of the metals in the alloy.

BRIEF DESCRIPTION OF THE DRAWINGS

The invention will now be described by way of example with reference to the accompanying Figures, of which.

DETAILED DESCRIPTION OF THE EMBODIMENTS

Figure 1:
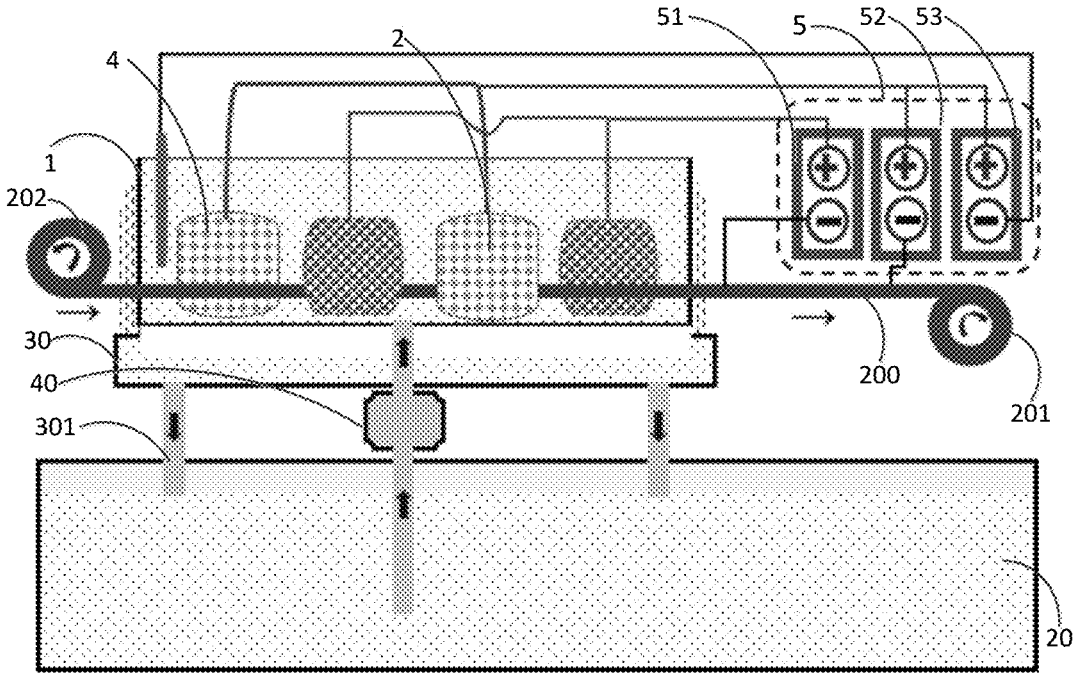
FIG. 1 is an illustrative view of an electroplating system according to an exemplary embodiment of the present invention, in which the electroplating bath is cut in a longitudinal direction.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An embodiment of the present disclosure includes an electroplating device suitable for electroplating an alloy comprising a plurality of metals onto a workpiece. The electroplating device includes an electroplating bath suitable for containing an electroplating solution in which the workpiece as a cathode is at least partially immersed. A plurality of groups of anodes are provided, with each group including at least one metal required for electroplating. An electrolytic potential of at least one metal of each group of anodes is distinct from that of at least one metal of any other group of anodes. The device further includes a power supply suitable for adjusting the proportion of current transmitted to each group of anodes according to the proportion of the metals in the alloy.

According to another embodiment of the present disclosure, an electroplating system includes the above-described electroplating device, a tank into which the electroplating solution overflowing from the electroplating bath flows, and a pump suitable for pumping the electroplating solution in the tank to the inlet of the liquid spraying device through a pipe.

Figure 2:
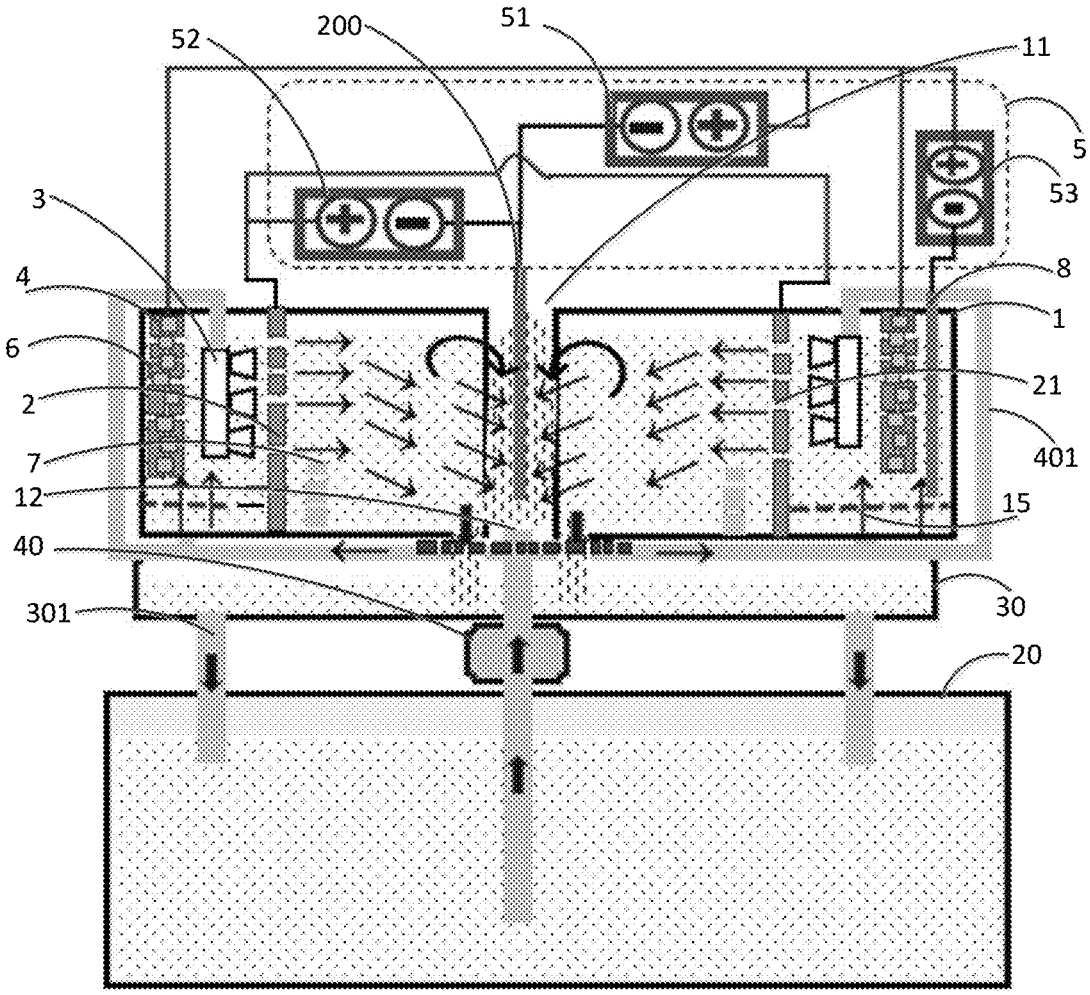
FIG. 2 is another illustrative view of the electroplating system shown in FIG. 1, in which the electroplating bath is cut in a transverse direction.
Figure 3:
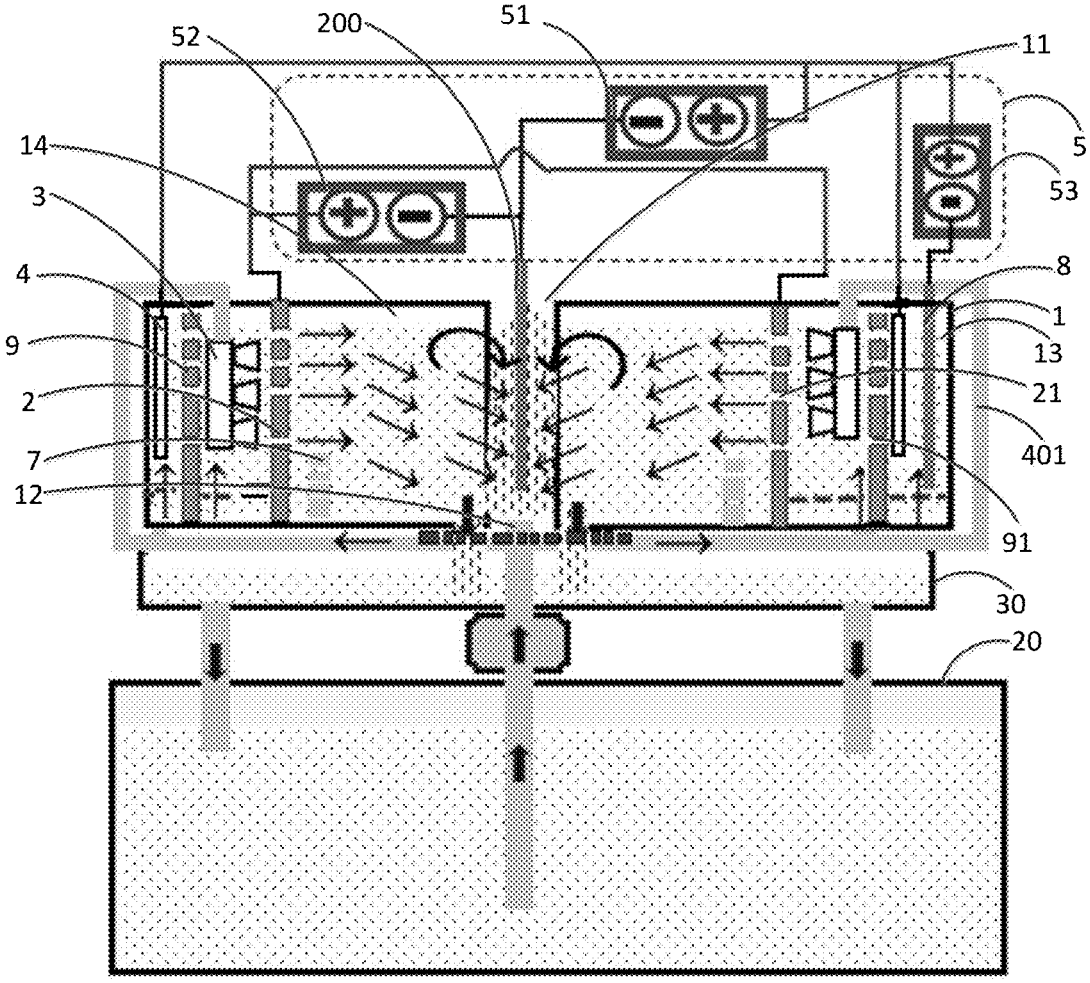
FIG. 3 is an illustrative perspective view of an electroplating device according to an exemplary embodiment of the present invention.

FIG. 1 is an illustrative view of an electroplating system according to an exemplary embodiment of the present invention, in which the electroplating bath is cut in a longitudinal direction. FIG. 2 is another illustrative view of the electroplating system shown in FIG. 1, in which the electroplating bath is cut in a transverse direction. FIG. 3 shows an illustrative perspective view of an electroplating device according to an exemplary embodiment of the present invention.

According to an exemplary embodiment of the present disclosure, as shown in FIGS. 1-3, an electroplating system comprises an electroplating device 300, a tank 20 and a pump 40. In an associated electroplating process, the electroplating solution overflowing from an electroplating bath 1 of the electroplating device 300 flows into the tank 20. The pump 40 is suitable for pumping the electroplating solution in the tank 20 to the electroplating bath 1 through a pipe 401 to supplement the electroplating solution supplied to the electroplating bath.

The electroplating device 300 is adapted to electroplate a metal layer on a workpiece 200 by roll plating or hanging plating. The electroplated workpiece 200 can be arranged or directly connected to a material strip to move with the material strip. The electroplating device 300 includes the electroplating bath 1, a plurality of groups of anodes 2, 4 and a power supply device 5. The electroplating bath 1 is adapted to contain the electroplating solution in which the workpiece 200 to be electroplated as a cathode is at least partially immersed. Each group of the anodes provides at least one metal required for electroplating, and the electrolytic potential of at least one metal of each group of anodes is different from that of at least one metal of any other group of anodes. The power supply device 5 is adapted to adjust the proportion of current transmitted to each group of anodes according to the proportion of the metals in the alloy. In the electroplating device 300 according to the embodiment of the disclosure, the proportion of current transmitted to each group of anodes 2, 4 can be adjusted so that the proportion of metal ions in the electroplating solution is always balanced, and the alloy proportion of the alloy electrodeposited coating can be accurately controlled.

In an exemplary embodiment, the conductive layer includes tin silver alloy, gold cobalt alloy, gold nickel alloy, palladium nickel alloy, tin nickel alloy, zinc nickel alloy, tin bismuth alloy, tin lead alloy, copper zinc tin alloy, zinc nickel iron alloy, etc. For example, the electrolytic potential of zinc (Zn (2+)) is −0.76V, the electrolytic potential of nickel (Ni (2+)) is −0.25V, the electrolytic potential of tin (Sn (2+)) is −0.14V, the electrolytic potential of lead (Pb (2+)) is −0.13V, the electrolytic potential of copper (Cu (2+)) is +0.34V, the electrolytic potential of silver (Ag (1+)) is +0.80V, and the electrolytic potential of gold (Au (1+)) is +1.68V.

In an exemplary embodiment, the power supply device 5 is adapted to adjust the proportion of current transmitted to each group of anodes according to the electrolysis speed of the plurality of groups of anodes, so as to keep the proportion of each metal in the required alloy electrodeposited coating stable. The power supply device 5 may be a DC power supply or a pulse power supply that may provide a pulsing voltage or current.

In an exemplary embodiment, the plurality of groups of anodes include a first anode group 2 and a second anode group 4, and the electrolytic potential of at least one metal of the first anode group 2 is higher than that of at least one metal of the second anode group 4. The first anode group 2 may be made of a single metal to provide one of the metals required for alloy electroplating. The first anode group 2 may also be made of an alloy to provide several metals required for alloy electroplating. Similarly, the second anode group 4 may be made of a single metal to provide one of the metals required for alloy electroplating. The second anode group 4 may also be made of an alloy to provide several metals required for alloy electroplating.

In an exemplary embodiment, if the electroplated coating is a ternary alloy, two anode groups can be used. For example, the first anode group 2 may be a soluble single metal anode, and the second anode group 4 may be a soluble binary alloy anode. In an alternative embodiment, if the electroplated coating is a ternary alloy, three anode groups may be provided, each made of a single metal. The first anode group 2 includes a plurality of first anodes arranged at intervals and can be immersed in a multicomponent alloy electroplating solution without supplying the electric power.

In an exemplary embodiment, as shown in FIGS. 1 and 2, the power supply device 5 includes a first current regulator 51 suitable for adjusting the current transmitted to the first anode group 2 and a second current regulator 52 suitable for adjusting the current transmitted to the second anode group 4. In this way, the current(s) transmitted to the first anode group and the second anode group can be respectively controlled.

The electroplating device 300 also includes a weak electrolysis device suitable for ensuring that the second anode group 4 immersed in the electroplating solution has a positive potential when the first anode group 2 and the second anode group 4 stop the electroplating operation (i.e. no current is transmitted to the first anode group and the second anode group), to prevent a displacement reaction between the second anode group 4 and the electroplating solution. In an exemplary embodiment, the weak electrolysis device includes an auxiliary cathode 8 and a third current regulator 53. The cathode of the third current regulator 53 is connected to the auxiliary cathode 8, and the anode of the third current regulator 53 is connected to the second anode 4. The third current regulator 53 is adapted to supply power to the second anode 4 as the second anode group 4 is immersed in the electroplating solution and the second current regulator 52 stops transmitting current to the second anode 4. As a result, the second anode 4 has a positive potential to prevent the replacement reaction between the second anode 4 and the electroplating solution.

In one embodiment of the disclosure, the auxiliary cathode 8 is a weak electrolytic electrode, for example, made of inert conductors such as titanium, carbon and SUS316 stainless steel. The weak current flowing through the second anode 4 (low potential metal anode) is controlled to be about 0.01 A by the third current regulator 53, so that the second anode 4 is weakly positive without being replaced by the high potential metal in the electroplating solution. At the same time, when the auxiliary cathode 8 is electroplated with as few alloy coatings as possible (to reduce loss), it will also absorb the foreign metal pollution in the electroplating solution, so as to purify the electroplating solution.

The first current regulator and the second current regulator can share one power supply or connect different power supplies, respectively. The first, second and third current regulators may each include a rectifier, such as a thyristor rectifier, and an adjustable resistance may also be included. Different anode groups are respectively equipped with current regulators, and the current density is dispersed to different metal anodes and evenly distributed, so as to stabilize the alloy proportion of the electrodeposited coating. In addition, the currents transmitted to different anode groups can be independently controlled and the current ratio can be adjusted to obtain electroplating coatings with different alloy ratios.

In one embodiment of the present disclosure, the second anode group 4 is separated from the electroplating solution when the first anode group 2 and the second anode group 4 stop the electroplating operation. For example, the second anode group 4 is configured to be movable so that when the first anode group 2 and the second anode group 4 stop the electroplating operation, the second anode group 4 is moved out of the electroplating solution, for example, above the electroplating bath 1, so as to prevent the replacement reaction between the second anode 4 and the electroplating solution. In another alternative embodiment, the second anode group is configured so that when the first anode group 2 and the second anode group 4 stop the electroplating operation, the liquid level of the electroplating solution in the electroplating bath 1 decreases, for example, by turning off the pump 40 so that all the electroplating solution in the electroplating bath 1 returns to the tank 20. As a result, the second anode group 4 is separated from the electroplating solution, preventing the displacement reaction between the second anode 4 and the electroplating solution.

The electroplating device according to the embodiment of the present invention is provided with a plurality of anode groups, each anode group shares a corresponding proportion of current, the current density of the anode group is moderate, and the anode polarization degree is small and slow, so as to maintain the high electroplating efficiency.

Still referring to FIGS. 1-3, the second anode 4 is placed in a basket 6 with a plurality of first through holes permitting the electroplating solution to flow into or out of the basket through the first through holes to cause an impact on the second anode.

Figure 4:
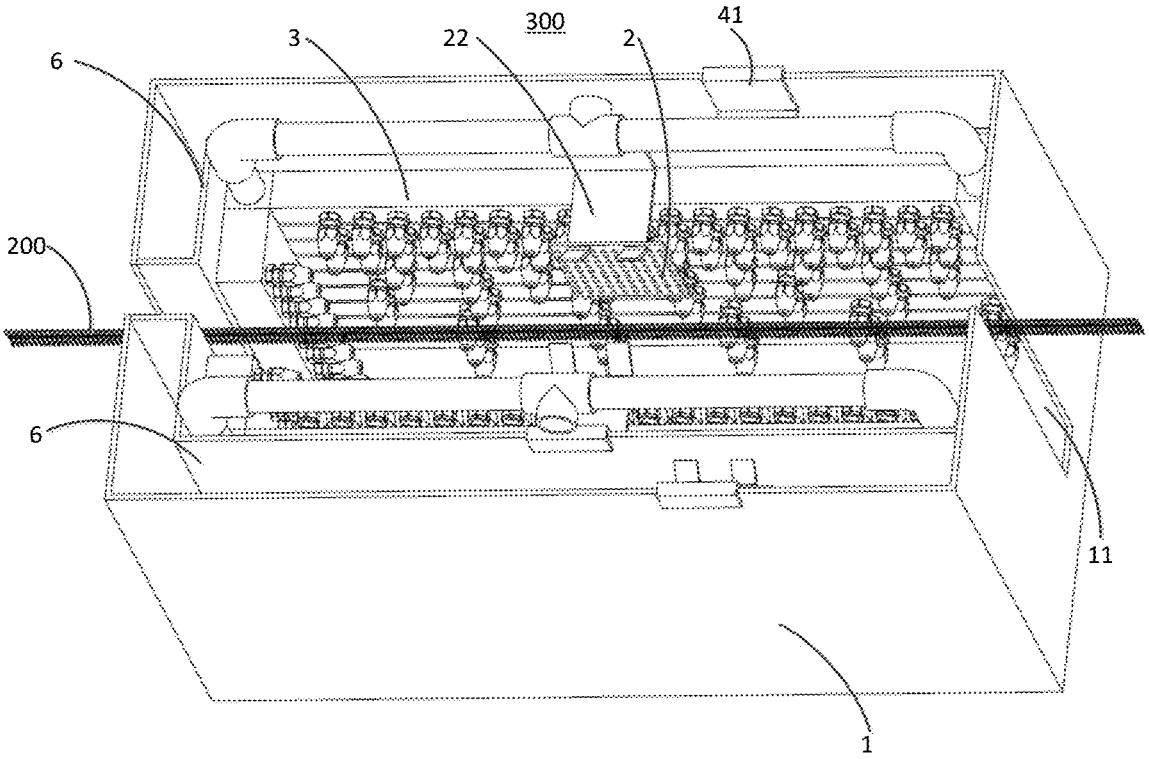
FIG. 4 is an illustrative perspective view of an electroplating device according to another exemplary embodiment of the present invention.

FIG. 4 shows an illustrative perspective view of an electroplating device according to another exemplary embodiment of the present invention. As shown in FIGS. 1-2 and 4, the electroplating device 300 also includes two partition walls 9, which are adapted to separate the electroplating bath 1 into an outer containing part 13 and an inner containing part 14 located inside the outer containing part. Multiple pairs of the first anodes 2 are arranged in the inner containing part and multiple pairs of the second anodes 4 are arranged in the outer containing part 13. The partition wall 9 is provided with a plurality of second through holes 91 to allow the electroplating solution in the outer containing part 13 to flow through the second through holes 91 into the inner containing part 14.

Figure 5:
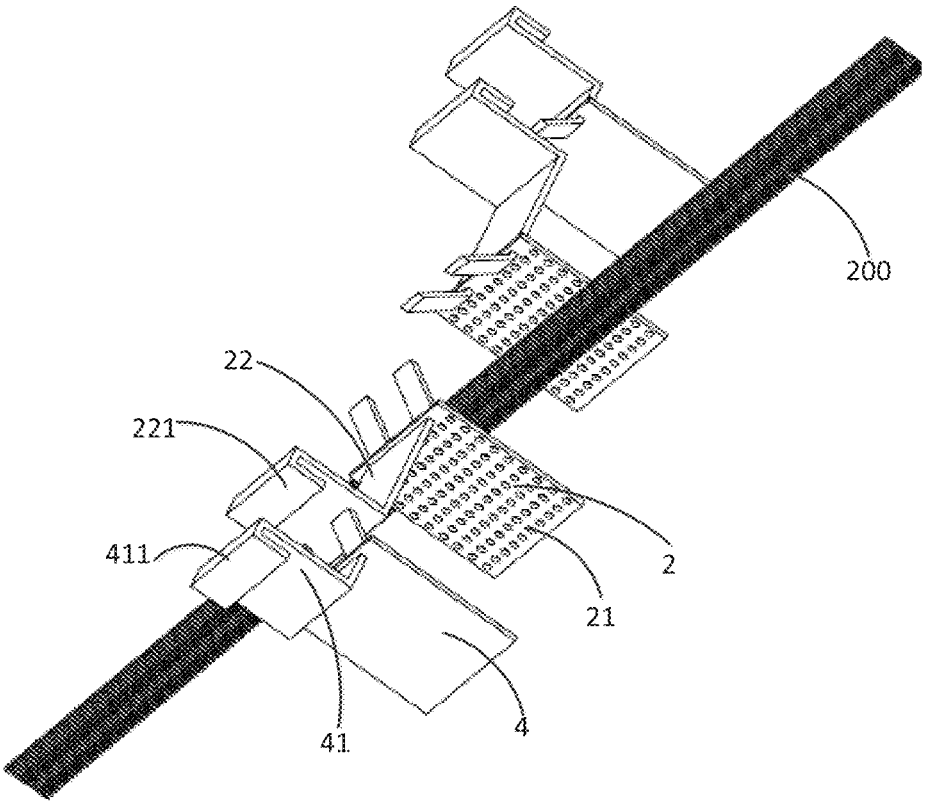
FIG. 5 is an illustrative perspective view of an anode and a workpiece according to an exemplary embodiment of the present invention.
Figure 6:
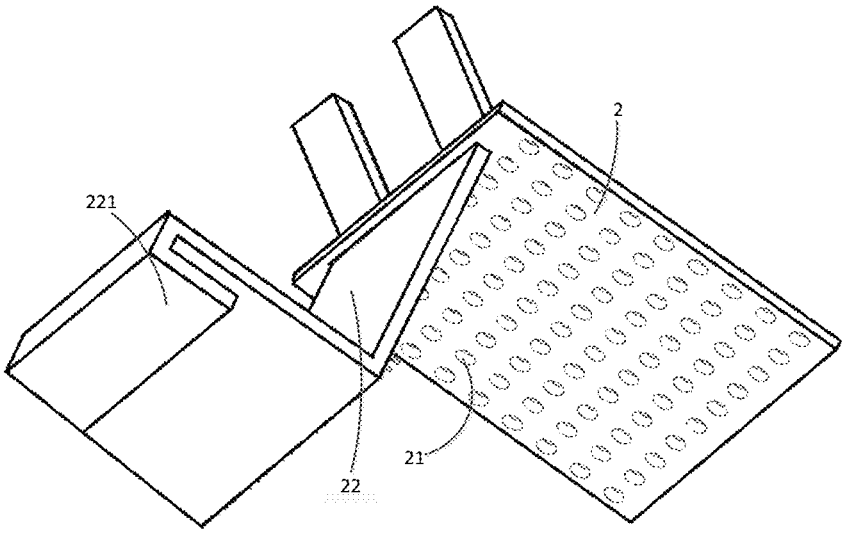
FIG. 6 is an illustrative perspective view of a first anode according to an exemplary embodiment of the present invention.

FIG. 5 shows an illustrative perspective view of an anode and a workpiece according to an exemplary embodiment of the present disclosure; FIG. 6 shows an illustrative perspective view of a first anode according to an exemplary embodiment of the present invention. As shown in FIGS. 4-6, in one embodiment, the first anode 2 is installed on the partition wall 9 by a first bracket 22, and the second anode is installed on the side wall of the electroplating bath by a second bracket 41. For example, hooks 221 and 411 are respectively provided on the first bracket 22 and the second bracket 41 to conveniently hang the first bracket 22 and the second bracket 41 detachably on the partition wall 9 and the side wall of the electroplating bath 1.

Figure 7:
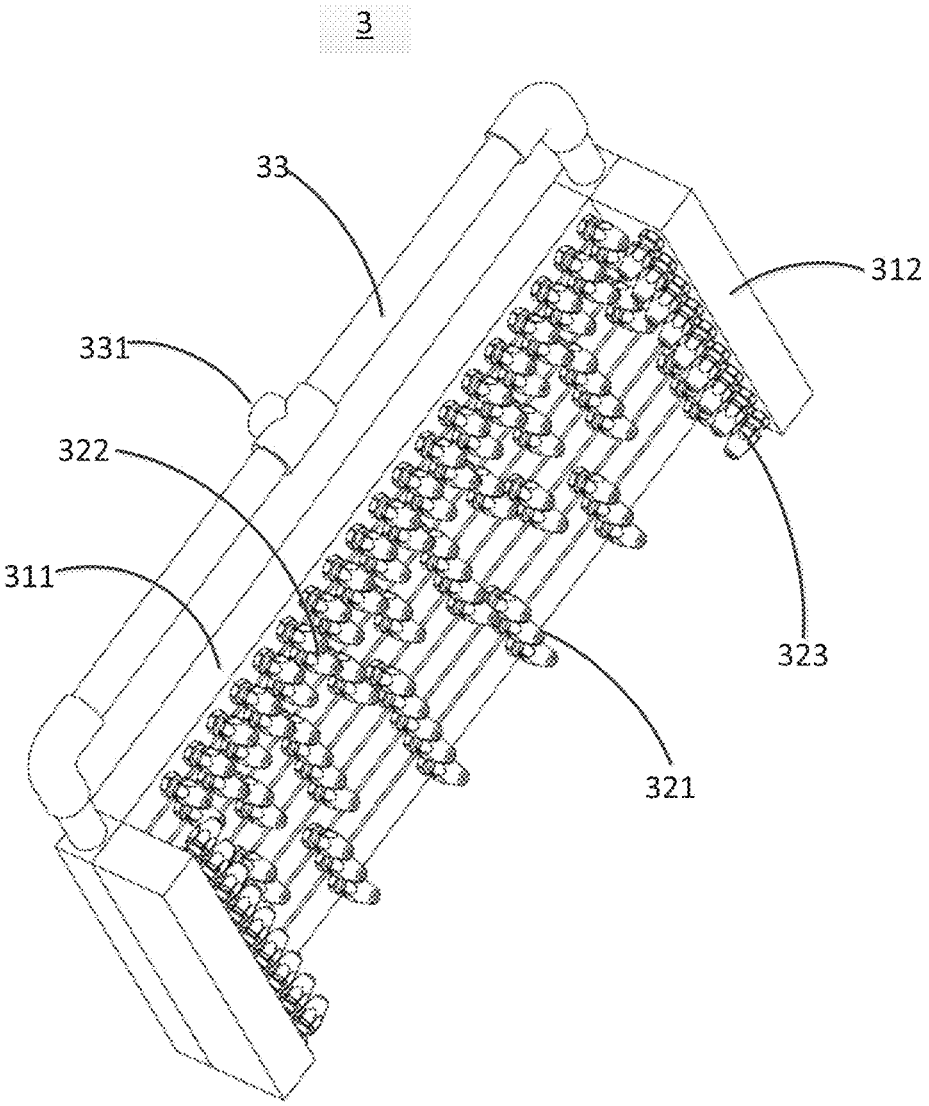
FIG. 7 is an illustrative perspective view of a liquid spraying device according to an exemplary embodiment of the present invention.

FIG. 7 shows an illustrative perspective view of a liquid spraying device according to an exemplary embodiment of the present disclosure. As shown in FIGS. 3-7, the electroplating device 300 also includes a liquid spraying device 3. The liquid spraying device 3 is configured to spray electroplating solution towards the first anode 2 and arranged in the inner containing part 14. The liquid spraying device 3 includes a main body part 31 and a plurality of nozzles 32. The main body part 31 is provided with at least one inlet for conveying electroplating solution into the main body part 31. The plurality of nozzles 32 are mounted on the main body part 31, at least part of the nozzles 32 are configured so that the flow direction of the electroplating solution ejected from the nozzle is substantially parallel to the direction of the power line formed by the first anode group and the cathode.

Generally, the liquid flow direction of the electroplating solution acting on the electroplated strip is parallel to the power line and perpendicular to the electroplated strip and is a liquid flow direction with the highest electroplating efficiency. According to an embodiment of the present disclosure, at least part of the nozzle of the liquid spraying device can strongly spray the electroplating solution with a certain flow rate towards the cathode (that is, the workpiece 200 to be electroplated), and the flow direction of the electroplating solution sprayed from the nozzle is substantially parallel to the direction of the power line formed by the first anode and the cathode, which can improve the electroplating efficiency.

In an exemplary embodiment, as shown in FIG. 4, the first anode 2 is arranged between the liquid spraying device 3 and the workpiece 200. The first anode 2 is provided with a plurality of third through holes 21, and a part of the electroplating solution ejected from the nozzle 32 flows through the third through holes 21.

In an embodiment, the first anode group includes a plurality of first anodes, with a gap provided between two adjacent first anodes. For example, the first anode is configured as a flat plate, which is reticulated, has a plurality of third through holes 21, or is composed of multiple sections and slots to allow liquid flow penetration and play a certain buffer role. Part of the electroplating solution reaches the surface of the electroplated workpiece through the third through holes 21 on the first anode or the gap between two adjacent first anodes. The electroplating solution flow can fully impact the first anode, effectively activate the first anode, accelerate the metal dissolution rate of the first anode and disperse into the electroplating solution in time, so as to further improve the working efficiency of the first anode, reduce the amount of the first anode. Further, the dissolution by-products of the first anode (such as anode mud) can also flow to the tank 20 in time, so that the electroplating solution can be filtered and cleaned to avoid the coarseness of the electroplating coating due to impurities.

In an exemplary embodiment, as shown in FIGS. 3, 4 and 7, for example, the pipe 401, the electroplating bath 1 and the nozzle 32 may be made of non-metallic insulation materials such as polypropylene (PP) and polytetrafluoroethylene and corrosion-resistant materials. The nozzle 32 is detachably mounted on the main body part 31. In this way, nozzles of different models and sizes can be replaced according to the type of workpiece 200 to be electroplated or the type of electroplating solution. The spray direction of at least part of the nozzles is adjustable. In this way, the injection angle of the liquid flow of the electroplating solution ejected by the nozzle can be changed to adapt to the change of the shape and/or structure of the workpiece 200 to be electroplated.

The nozzles 32 are arranged to be sparse in the high current density region and compact in the low current density region. The plurality of nozzles are arranged in parallel in the horizontal direction, or in parallel in the vertical direction, or cross. Further, the arrangement density of the nozzles 322 located at the upper part of the main body part 31 is greater than that of the nozzles 321 located at the lower part of the main body part. In this way, the flow speed of the electroplating solution combined with the current density can improve the uniformity of the electroplating coating to be electroplated on the workpiece 200.

The main body part 31 of the liquid spraying device 3 includes a first part 311 and two second parts 312. The two second parts 312 are respectively arranged at both ends of the main body part 311 and extend towards the workpiece 200. In this way, in the top view, the main body parts 31 of the two opposite liquid spraying devices 3 form an approximate "H" shape. The nozzle 32 of each liquid spraying device 3 includes a plurality of first nozzles 321, 322 and a plurality of second nozzles 323. The first nozzles 321 and 322 are installed on the first part 311, and the flow direction of the electroplating solution ejected from the first nozzle is substantially parallel to the direction of the power line formed by the first anode 2 and the cathode.

A plurality of second nozzles 323 are arranged on the inner side of the two second parts 312 and eject electroplating solution in opposite directions. That is, the second nozzles provided on the two second parts 312 sprays electroplating solution towards the workpiece 200 in the longitudinal direction. With the electroplated workpiece 200 as the center, the electroplating solution is sprayed from the first nozzle and the second nozzle at various angles in the left-right direction and the front and rear direction respectively, forming a multi angle strong jet to surround the electroplated workpiece as the cathode. The strong jet impacts the pothole dead corner of the workpiece, which can improve the finish, uniform electroplating ability and adhesion of the electroplating coating. The electroplating device according to the embodiment of the present invention is particularly suitable for electroplating of functional areas on concealed places, such as sides, holes, depressions, cup openings and complex parts in the cavity, such as terminals with crimping surface on the side and female terminals with contact surface in the cup opening or cavity structure.

In an exemplary embodiment, the workpiece 200 is provided on a material strip by direct connection or detachable installation, for example, the material strip is arranged to move horizontally through the electroplating bath 1, and the flow direction (transverse direction) of the electroplating solution ejected from the first nozzle is perpendicular to the moving direction (longitudinal direction) of the material strip. The electroplating device according to the embodiment of the invention can avoid the phenomenon of thin liquid on the back surface of the workpiece when the material strip runs at high speed, so as to improve the electroplating efficiency.

In an exemplary embodiment, as shown in FIG. 3, two opposite side walls of the electroplating bath 1 are respectively provided with overflow ports 11, and the material strip moves through the overflow ports 11. The electroplating solution in the electroplating bath 1 can flow out of the overflow port 11.

FIGS. 8A-8D show an illustrative perspective view of a pipe installed in different ways according to an exemplary embodiment of the present disclosure. In order to realize the flow of electroplating solution in multiple directions, a variety of liquid inlet holes can be set to transport electroplating solution from different parts to the electroplating bath. In an exemplary embodiment, as shown in FIGS. 1, 2 and 8A-8D, the bottom wall of the electroplating bath 1 is provided with a first liquid inlet hole 15 substantially aligned with the second anode, which is suitable for conveying electroplating solution towards the second anode 4 in a vertical direction. The bottom wall of the electroplating bath 1 is provided with a second liquid inlet hole 12 substantially aligned with the workpiece 200, which is suitable for conveying electroplating solution towards the workpiece 200 in the vertical direction.

Figure 8A:
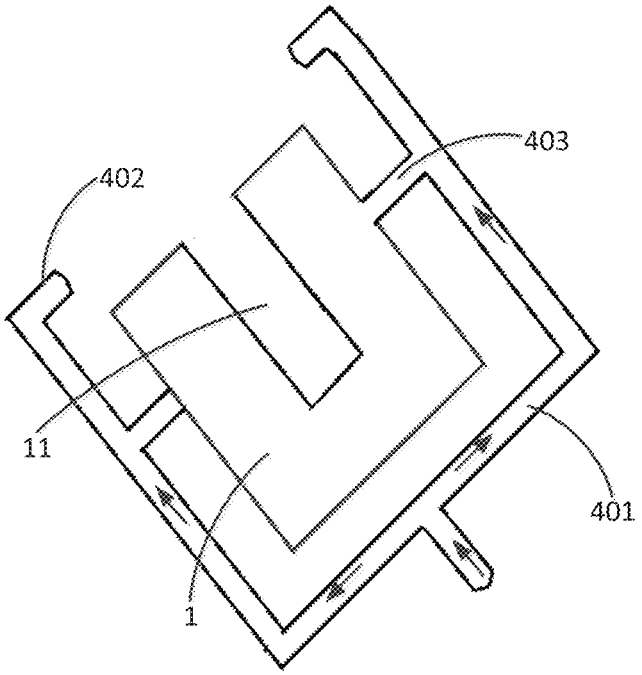
FIGS. 8A-8D are illustrative perspective views of a pipe installed in different arrangements according to an exemplary embodiment of the present invention.

In an exemplary embodiment, as shown in FIG. 8A and referring to FIG. 2, the pipe 401 is provided with a first outlet 402 for communicating with the inlet 331 of the liquid spraying device 3 and a second outlet 403 for conveying the electroplating solution from the side wall of the electroplating bath 1 to the inside of the electroplating bath 1.

Figure 8B:
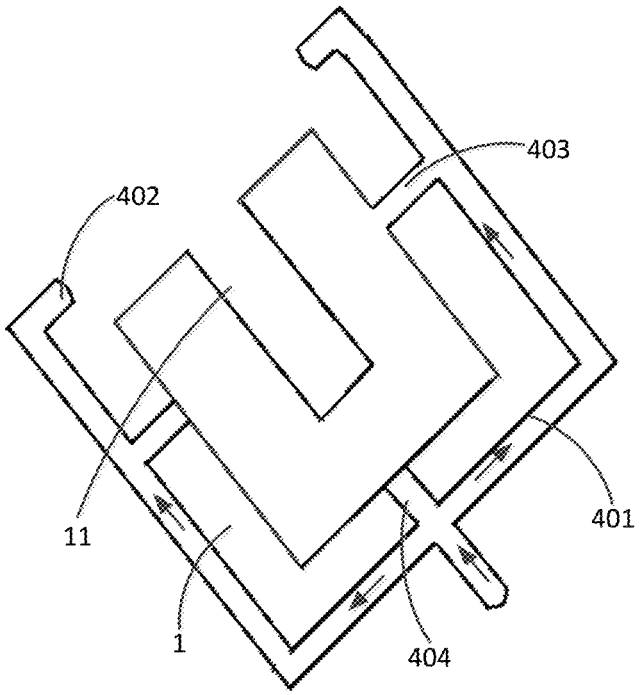

In an exemplary embodiment, as shown in FIG. 8B and referring to FIG. 2, the conveying pipe 401 is provided with a first outlet 402 for communicating with the inlet 331 of the liquid spraying device 3, a second outlet 403 for conveying the electroplating solution from the side wall of the electroplating bath 1 to the inside of the electroplating bath 1, and a third outlet 404 for communicating with the second liquid inlet hole 12 on the bottom wall of the electroplating bath 1.

Figure 8C:
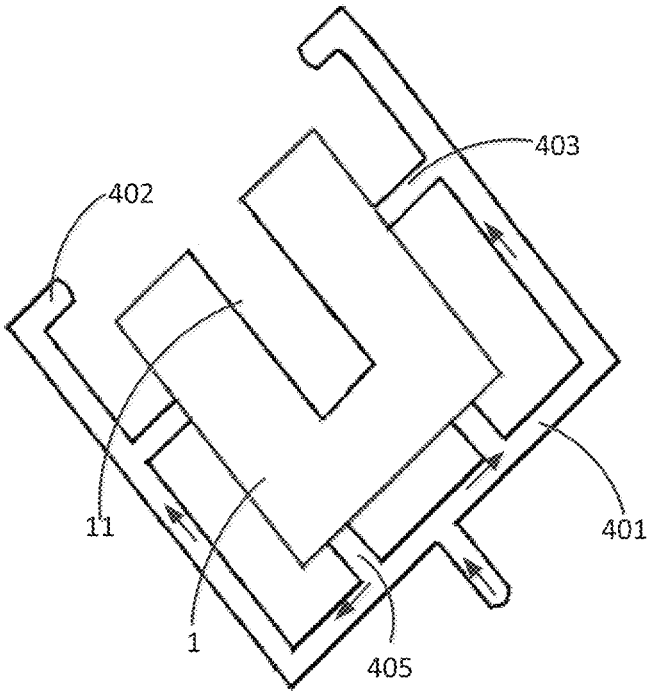

In an exemplary embodiment, as shown in FIG. 8C and referring to FIG. 2, the pipe 401 is provided with a first outlet 402 for communicating with the inlet 331 of the liquid spraying device 3, a second outlet 403 for conveying the electroplating solution from the side wall of the electroplating bath 1 to the inside of the electroplating bath 1, and a fourth outlet 405 communicating with the first liquid inlet hole 15 on the bottom wall of the electroplating bath 1.

Figure 8D:
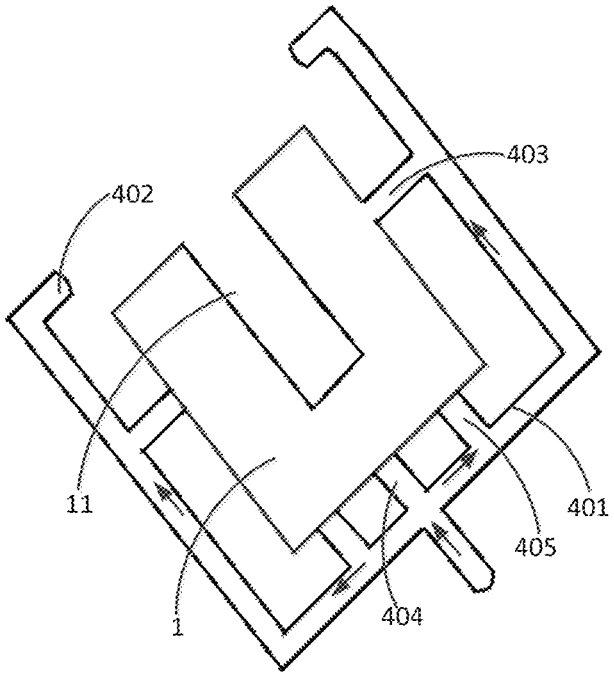

In an exemplary embodiment, as shown in FIG. 8D and referring to FIG. 2, the pipe 401 is provided with a first outlet 402 for communicating with the inlet 331 of the liquid spraying device 3, a second outlet 403 for conveying the electroplating solution from the side wall of the electroplating bath 1 to the inside of the electroplating bath 1, a third outlet 404 communicating with the second liquid inlet hole 12 on the bottom wall of the electroplating bath 1, and a fourth outlet 405 communicated with the first liquid inlet hole 15 on the bottom wall of the electroplating bath 1.

In an exemplary embodiment, as shown in FIG. 2, a pair of adjustment covers 7 are arranged on both sides of the second liquid inlet hole 12, which are suitable for adjusting the liquid level of the electroplating solution at the workpiece 200. Since the electroplating bath 1 is provided with the nozzle 32, the partition walls 9, the liquid inlet hole and other mechanisms to promote or block the flow of electroplating solution, the liquid level of electroplating solution in the electroplating bath may be different in different parts. By setting the adjustment covers 7, the liquid level of electroplating solution at the workpiece 200 can be adjusted.

According to another embodiment of the disclosure, as shown in FIGS. 1 and 2, the electroplating system includes the electroplating device 300, the tank 20 and the pump 40 according to any of the above embodiments, and the electroplating solution overflowing from the electroplating bath 1 flows into the mother tank 20. The pump 40 is suitable for pumping the electroplating solution in the tank 20 to the inlet 301 of the liquid spraying device 3 through the pipe 401, and the electroplating solution inside the liquid spraying device 3 is sprayed into the electroplating bath from each nozzle 32. The electroplating device 300 also includes a transition tank 30, and the electroplating solution overflowing from the electroplating bath 1 flows to the tank 20 through the transition tank 30.

In an exemplary embodiment, the electroplating system further includes a winding barrel 201 and an unwinding barrel 202. The material strip carrying the workpieces is wound onto the winding barrel 201, and the material strip is unwounded from the unwinding barrel 202. In this way, driven by the winding barrel, the electroplated workpiece arranged on the material strip can move longitudinally in the electroplating bath.

Referring to FIGS. 1 and 2, the arrow in the figures indicates the flow direction of electroplating solution. The electroplating solution in the electroplating bath 1 first flows into the transition tank 30 from the overflow port 11 of the electroplating bath, and then flows into the tank 20 through the return pipe 301 of the transition tank 30, so that the electroplating solution can be filtered and cleaned. The electroplating solution in the tank 20 is then transported to the liquid spraying device 3 through the pipe 401 by the pump 40, and sprayed into the electroplating bath from the nozzle 32.

It should be noted that in the embodiment shown in FIG. 1, the pipe 401 can deliver electroplating solution to the electroplating bath 1 through the second liquid inlet hole 12 on the bottom wall of the electroplating bath 1. In addition, the electroplating solution in the electroplating bath 1 can also flow to the transition tank 30 through other openings on the bottom wall. It can be understood that the electroplating solution can flow into and out of the electroplating bath through a plurality of liquid inlet holes and openings, which can allow the electroplating solution to flow in multiple directions.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electroplating device adapted to electroplate an alloy comprising a plurality of metals on a workpiece, the electroplating device comprising:

an electroplating bath containing an electroplating solution in which the workpiece acting as a cathode is at least partially immersed;

a plurality of groups of anodes including a first anode group and a second anode group, each group providing at least one metal required for electroplating, an electrolytic potential of at least one metal of each group of anodes is distinct from that of at least one metal of any other group of anodes;

a power supply device adjusting the proportion of current transmitted to each group of anodes according to the proportion of the metals in the alloy; and two partition walls separating the electroplating bath into an outer containing part and an inner containing part located inside the outer containing part, the first anode group is arranged in the inner containing part, the second anode group is arranged in the outer containing part, the partition walls are provided with through holes to allow the electroplating solution in the outer containing part to flow into the inner containing part through the through holes.

2. The electroplating device according to claim 1, wherein the power supply device further adjusts the proportion of current transmitted to each group of anodes according to the electrolysis speed of the plurality of groups of anodes.

3. The electroplating device according to claim 1, wherein the plurality of groups of anodes include a first anode group and a second anode group, and the electrolytic potential of at least one metal of the first anode group is higher than that of at least one metal of the second anode group.

4. The electroplating device according to claim 3, wherein the power supply device comprises:

a first current regulator regulating the current transmitted to the first anode group; and a second current regulator regulating the current transmitted to the second anode group.

5. The electroplating device according to claim 4, further comprising a weak electrolysis device adapted to ensure that the second anode group immersed in the electroplating solution has a positive potential when the first anode group and the second anode group stop the electroplating operation.

6. The electroplating device according to claim 5, wherein the weak electrolysis device comprises an auxiliary cathode and a third current regulator, the cathode of the third current regulator is connected to the auxiliary cathode, and the anode of the third current regulator is connected to the second anode group, the third current regulator supplying power to the second anode group as the second current regulator stops transmitting current to the second anode group, so that the second anode group has a positive potential to prevent the replacement reaction between the second anode group and the electroplating solution.

7. The electroplating device according to claim 6, wherein the third current regulator maintains the current in the circuit of the weak electrolysis device at 0.01 ampere.

8. The electroplating device according to claim 3, wherein the electroplating device separates the second anode group from the electroplating solution when the first anode group and the second anode group stop the electroplating operation.

9. The electroplating device according to claim 8, wherein the electroplating device moves the second anode group out of the electroplating solution when the first anode group and the second anode group stop the electroplating operation, and the electroplating device reducing reduces the liquid level of the electroplating solution in the electroplating bath when the first anode group and the second anode group stop the electroplating operation, so that the second anode group is separated from the electroplating solution.

10. The electroplating device according to claim 1, wherein the second anode group is placed in a basket with a plurality of first basket through holes.

11. The electroplating device according to claim 1, wherein the first anode group is installed on the partition wall by a first bracket, and the second anode group is installed on the side wall of the electroplating bath by a second bracket.

12. The electroplating device according to claim 1, further comprising a liquid spraying device configured to spray the electroplating solution towards the first anode group, the liquid spraying device comprises:

a main body part provided with at least one inlet for conveying the electroplating solution into the main body part; and a plurality of nozzles installed on the main body part, wherein at least part of the nozzles are arranged so that a flow direction of the electroplating solution ejected from the nozzle is substantially parallel to a direction of a power line formed by the first anode group and the cathode.

13. The electroplating device according to claim 12, wherein the first anode group is provided between the liquid spraying device and the workpiece, and a plurality of anode through holes are formed on each first anode of the first anode group, and a part of the electroplating solution ejected from the nozzle flows through the anode through holes.

14. The electroplating device according to claim 12, wherein the main body part comprises:

a first part; and two second parts respectively provided at both ends of the main body part and extending towards the workpiece, the nozzle comprises:

a plurality of first nozzles installed on the first part, and the flow direction of the electroplating solution ejected from the first nozzles is substantially parallel to the direction of the power line formed by the first anode group and the cathode; and a plurality of second nozzles provided on the inner side of the two second parts and adapted to eject the electroplating solution towards the workpiece.

15. The electroplating device according to claim 1, wherein the workpiece is arranged on a material strip which moves horizontally through the electroplating bath, the flow direction of the electroplating solution ejected from the first nozzle is perpendicular to the moving direction of the material strip, and wherein the material strip moves through two overflow ports respectively formed on two opposite side walls of the electroplating bath.

16. The electroplating device according to claim 1, wherein a plurality of first liquid inlet holes substantially aligned with the second anodes of the second anode group are formed on the bottom wall of the electroplating bath, and the first liquid inlet holes convey the electroplating solution to the second anodes in a vertical direction.

17. The electroplating device according to claim 1, wherein a plurality of second liquid inlet holes substantially aligned with the workpiece are formed on the bottom wall of the electroplating bath, and the second liquid inlet holes convey the electroplating solution to the workpiece in a vertical direction.

18. The electroplating device according to claim 17, wherein a pair of adjustment covers are respectively provided on both sides of the second liquid inlet hole, and the adjustment cover is suitable for adjusting the liquid level of the electroplating solution at the workpiece.

19. An electroplating system, comprising:

an electroplating device comprising:

an electroplating bath adapted to contain an electroplating solution in which a workpiece as a cathode is at least partially immersed;

a plurality of groups of anodes including a first anode group and a second anode group, each group providing at least one metal required for electroplating, an electrolytic potential of at least one metal of each group of anodes is distinct from that of at least one metal of any other group of anodes;

a power supply device adapted to adjust the proportion of current transmitted to each group of anodes according to the proportion of the metals in the alloy; and two partition walls separating the electroplating bath into an outer containing part and an inner containing part located inside the outer containing part, the first anode group is arranged in the inner containing part, the second anode group is arranged in the outer containing part, the partition walls are provided with a plurality of through holes to allow the electroplating solution in the outer containing part to flow into the inner containing part through the through holes;

a tank into which the electroplating solution overflowing from the electroplating bath is adapted to flow; and a pump adapted to pump the electroplating solution in the tank to an inlet of a liquid spraying device through a pipe.

20. An electroplating device adapted to electroplate an alloy comprising a plurality of metals on a workpiece, the electroplating device comprising:

an electroplating bath containing an electroplating solution in which the workpiece acting as a cathode is at least partially immersed;

a plurality of groups of anodes including a first anode group and a second anode group, each group providing at least one metal required for electroplating, an electrolytic potential of at least one metal of the first anode group is higher than that of at least one metal of the second anode group;

a power supply device adjusting the proportion of current transmitted to each group of anodes according to the proportion of the metals in the alloy, including:

a first current regulator regulating the current transmitted to the first anode group; and a second current regulator regulating the current transmitted to the second anode group; and a weak electrolysis device adapted to ensure that the second anode group immersed in the electroplating solution has a positive potential when the first anode group and the second anode group stop the electroplating operation, the weak electrolysis device includes a n auxiliary cathode and a third current regulator, the cathode of the third current regulator is connected to the auxiliary cathode, and the anode of the third current regulator is connected to the second anode group, the third current regulator supplying power to the second anode group as the second current regulator stops transmitting current to the second anode group, so that the second anode group has a positive potential to prevent the replacement reaction between the second anode group and the electro plating solution.

* * * * *